US010777145B2

(12) United States Patent
Lee et al.

(10) Patent No.: US 10,777,145 B2
(45) Date of Patent: Sep. 15, 2020

(54) DEMULTIPLEXER, DISPLAY DEVICE INCLUDING THE SAME, AND METHOD OF DRIVING THE DISPLAY DEVICE

(71) Applicant: SAMSUNG DISPLAY CO., LTD., Yongin-si, Gyeonggi-do (KR)

(72) Inventors: Seung Kyu Lee, Yongin-si (KR); Ji Su Na, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 725 days.

(21) Appl. No.: 15/225,713

(22) Filed: Aug. 1, 2016

(65) Prior Publication Data

US 2017/0053601 A1 Feb. 23, 2017

(30) Foreign Application Priority Data

Aug. 21, 2015 (KR) ..... 10-2015-0118206

(51) Int. Cl.

| | |
|---|---|
| ***G09G 3/3291*** | (2016.01) |
| ***G09G 3/3266*** | (2016.01) |
| ***G09G 3/3225*** | (2016.01) |
| ***G09G 3/3258*** | (2016.01) |
| *G09G 3/36* | (2006.01) |

(52) U.S. Cl.

CPC ..... *G09G 3/3291* (2013.01); *G09G 3/3225* (2013.01); *G09G 3/3258* (2013.01); *G09G 3/3266* (2013.01); *G09G 3/3685* (2013.01); *G09G 2300/0819* (2013.01); *G09G 2300/0842* (2013.01); *G09G 2310/0248* (2013.01); *G09G 2310/0262* (2013.01);

(Continued)

(58) Field of Classification Search

CPC .. G09G 3/3291; G09G 3/3258; G09G 3/3225; G09G 3/3266; G09G 2320/0238; G09G 2300/0842; G09G 2310/0248; G09G 3/3685; G09G 2310/0262; G09G 2300/0819; G09G 2310/08; G09G 2310/0297; G09G 3/3688; G09G 3/3275

See application file for complete search history.

(56) References Cited

U.S. PATENT DOCUMENTS

| | | | |
|---|---|---|---|
| 6,700,562 | B1 | 3/2004 | Knapp et al. |
| 6,897,843 | B2 | 5/2005 | Ayres et al. |

(Continued)

FOREIGN PATENT DOCUMENTS

| | | | |
|---|---|---|---|
| CN | 102929421 | A | 2/2013 |
| CN | 104809378 | A | 7/2015 |

(Continued)

OTHER PUBLICATIONS

EPO Extended Search Report dated Dec. 5, 2016, for corresponding European Patent Application No. 16184046.7 (13 pages).

(Continued)

*Primary Examiner* — Premal R Patel

(74) *Attorney, Agent, or Firm* — Lewis Roca Rothgerber Christie LLP

(57) ABSTRACT

A demultiplexer includes: a first transistor connected between a data input line and a first data output line; a second transistor connected between the data input line and a second data output line; and an initializing transistor configured to be simultaneously turned on with the first transistor to transmit an initializing voltage to the second data output line.

21 Claims, 7 Drawing Sheets

(52) U.S. Cl.
CPC . *G09G 2310/0297* (2013.01); *G09G 2310/08* (2013.01); *G09G 2320/0238* (2013.01)

(56) References Cited

U.S. PATENT DOCUMENTS

| | | | | |
|---|---|---|---|---|
| 8,299,990 | B2 | 10/2012 | Park et al. | |
| 8,988,385 | B2 | 3/2015 | Seo et al. | |
| 9,754,537 | B2 | 9/2017 | Lee et al. | |
| 2006/0151745 | A1 | 7/2006 | Kim et al. | |
| 2014/0146030 | A1* | 5/2014 | Lee | G09G 3/3208 345/212 |

FOREIGN PATENT DOCUMENTS

| | | | |
|---|---|---|---|
| EP | 1347436 | A2 | 9/2003 |
| EP | 1406240 | A2 | 4/2004 |
| KR | 10-0888461 | B1 | 3/2009 |
| KR | 10-0903496 | B1 | 6/2009 |
| KR | 10-0924143 | B1 | 10/2009 |
| TW | 201428717 | A | 7/2014 |

OTHER PUBLICATIONS

Chinese Office Action dated Mar. 4, 2020, for corresponding Chinese Patent Application No. 201610685986.X (8 pages).

* cited by examiner

DEMULTIPLEXER, DISPLAY DEVICE INCLUDING THE SAME, AND METHOD OF DRIVING THE DISPLAY DEVICE

CROSS-REFERENCE TO RELATED APPLICATION

This application claims priority to and the benefit of Korean Patent Application No. 10-2015-0118206, filed on Aug. 21, 2015, in the Korean Intellectual Property Office, the entire content of which is incorporated herein by reference in its entirety.

BACKGROUND

1. Field

Aspects of example embodiment of the present invention relate to a demultiplexer and a display device including the same.

2. Description of the Related Art

With the development of information technology, the importance of display devices as connection medium between users and information is growing. Thus, the use of display devices such as liquid crystal display devices and organic light emitting display devices is increasing.

A display device may include a data driver for supplying data signals to data lines, a scan driver for supplying scan signals to scan lines, and a plurality of pixels connected to the scan lines and the data lines.

On the other hand, in related art, in order to reduce manufacturing costs, a structure in which demultiplexers are added to output lines of the data driver may be utilized.

That is, the demultiplexers receive the data signals through the output lines of the data driver and may time-divisionally output the data signals to a larger number of data lines than the output lines of the data driver.

The above information disclosed in this Background section is only to enhance the understanding of the background of the invention, and therefore it may contain information that does not constitute prior art.

SUMMARY

Aspects of example embodiments of the present invention relate to a demultiplexer suitable for a display device with high resolution, a display device including the same, and a method of driving the display device.

A demultiplexer according to an embodiment of the present invention includes: a first transistor connected between a data input line and a first data output line; a second transistor connected between the data input line and a second data output line; and an initializing transistor configured to be simultaneously turned on with the first transistor to transmit an initializing voltage to the second data output line.

According to some embodiments, the first transistor and the initializing transistor are configured to be turned on or off by a same control signal, and the second transistor is configured to be turned on or off by a different control signal as a control signal of the first transistor.

According to some embodiments, the first transistor comprises a first electrode connected to the data input line, a second electrode connected to the first data output line, and a gate electrode connected to a first data control line.

According to some embodiments, the second transistor comprises a first electrode connected to the data input line, a second electrode connected to the second data output line, and a gate electrode connected to a second data control line.

According to some embodiments, the initializing transistor comprises a first electrode connected to an initializing power source line configured to provide the initializing voltage, a second electrode connected to the second data output line, and a gate electrode connected to the first data control line.

According to some embodiments, the demultiplexer further includes a third transistor connected between the data input line and a third data output line.

According to some embodiments, the initializing transistor is configured to simultaneously transmit an initializing voltage to the second data output line and the third data output line.

According to some embodiments, the first transistor and the initializing transistor are configured to maintain on states in a first period, and the second transistor is configured to maintain an on state in a second period that proceeds after the first period.

According to some embodiments of the present invention, a display device includes: a first pixel connected to a scan line and a first data output line; a second pixel connected to the scan line and a second data output line; a scan driver configured to supply a scan signal to the scan line; a data driver configured to supply a data signal to a data input line; and a demultiplexer configured to transmit the data signal supplied to the data input line to the first data output line and the second data output line, wherein the demultiplexer includes: a first transistor connected between the data input line and the first data output line and configured to be turned on in response to a first data control signal; a second transistor connected between the data input line and the second data output line and configured to be turned on in response to a second data control signal; and an initializing transistor connected between the second data output line and an initializing power source line configured to provide an initializing voltage, the initializing transistor being configured to be turned on in response to the first data control signal.

According to some embodiments, the scan signal overlaps the first data control signal and the second data control signal.

According to some embodiments, the first data control signal is supplied in a first period and a second period, the scan signal is supplied in the second period, a third period, and a fourth period, and the second data control signal is supplied in the fourth period and a fifth period.

According to some embodiments, the first transistor comprises a first electrode connected to the data input line, a second electrode connected to the first data output line, and a gate electrode connected to a first data control line configured to provide the first data control signal.

According to some embodiments, the second transistor comprises a first electrode connected to the data input line, a second electrode connected to the second data output line, and a gate electrode connected to a second data control line configured to provide the second data control signal.

According to some embodiments, the initializing transistor comprises a first electrode connected to the initializing power source line, a second electrode connected to the second data output line, and a gate electrode connected to the first data control line.

According to some embodiments, the display device further comprises a third pixel connected to the scan line and a third data output line, and the demultiplexer further comprises a third transistor connected between the data input line and the third data output line and is configured to be turned on in response to a third data control signal.

According to some embodiments, the third transistor comprises a first electrode connected to the data input line, a second electrode connected to the third data output line, and a gate electrode connected to a third data control line configured to provide the third data control signal.

According to some embodiments, the initializing transistor comprises a first electrode connected to the initializing power source line, a second electrode connected to the second data output line and the third data output line, and a gate electrode connected to the first data control line.

According to some embodiments, the first data control signal is supplied in a first period and a second period, the scan signal is supplied in the second period, a third period, and a fourth period, the second data control signal is supplied in the fourth period and a fifth period, and the third data control signal is supplied in the third period.

According to some embodiments of the present invention, in a method of driving a display device, the method includes: turning on a first transistor in a first period and a second period and supplying a first data signal to a first data output line connected to a first pixel; turning on an initializing transistor in the first period and the second period and supplying an initializing voltage to a second data output line connected to a second pixel; supplying a scan signal to a scan line connected to the first pixel and the second pixel in the second period, a third period, and a fourth period; and turning on a second transistor in the fourth period and a fifth period and supplying a second data signal to the second data output line.

According to some embodiments, the initializing transistor supplies the initializing voltage to a third data output line connected to a third pixel in the first period and the second period, and the method further comprises turning on a third transistor in the third period and supplying a third data signal to the third data output line.

According to the embodiment of the present invention, a demultiplexer may be capable of being applied to high resolution display devices and may be capable of securing a supply period of a scan signal. Embodiments of the present invention also relate to a display device including the demultiplexer, and a method of driving the display device.

BRIEF DESCRIPTION OF THE DRAWINGS

Aspects of example embodiments will now be described more fully hereinafter with reference to the accompanying drawings; however, the present invention may be embodied in different forms and should not be construed as limited to the embodiments set forth herein. Rather, these embodiments are provided so that this disclosure will be more thorough and more complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
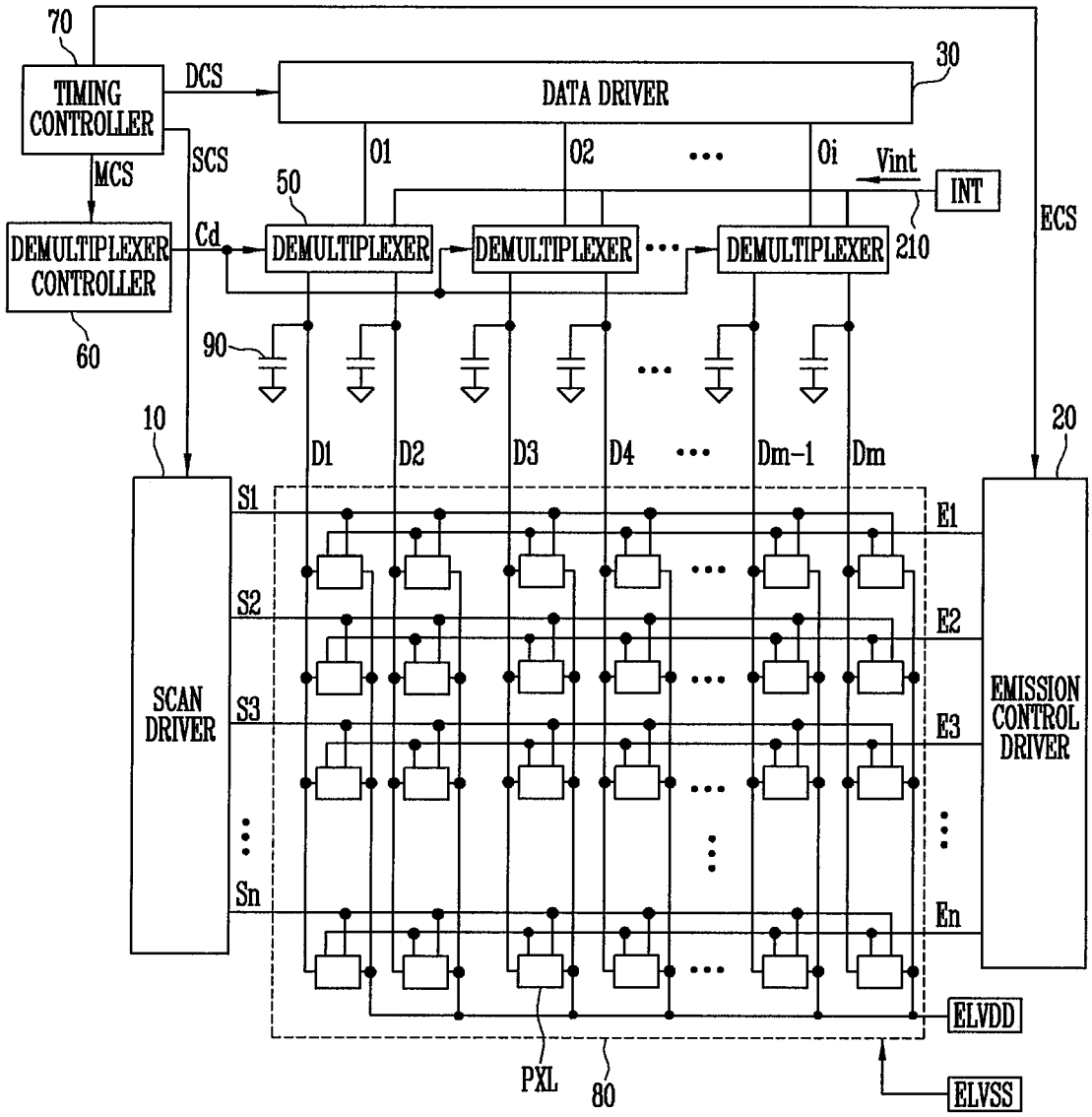
FIG. 1 is a view illustrating a display device according to an embodiment of the present invention.

Aspects of example embodiments of the present invention are described in more detail below.

Aspects and characteristics of the present invention, and implementation methods thereof will be clarified through following embodiments described with reference to the accompanying drawings. The present invention may, however, be embodied in different forms and should not be construed as limited to the embodiments set forth herein. Throughout this specification and the claims that follow, when it is described that an element is "connected" to another element, the element may be "directly connected" to the other element or "electrically connected" to the other element through a third element. In the accompanying drawings, a portion irrelevant to description of the present invention will be omitted for clarity. Like reference numerals refer to like elements throughout.

Hereinafter, with reference to the drawings related to the embodiments of the present invention, a demultiplexer, a display device including the same, and a method of driving the display device according to an embodiment of the present invention will be described.

FIG. 1 is a view illustrating a display device according to an embodiment of the present invention.

Referring to FIG. 1, the display device according to the embodiment of the present invention may include a plurality of pixels PXL, a scan driver 10, an emission control driver 20, a data driver 30, a plurality of demultiplexers 50, a demultiplexer controller 60, and a timing controller 70.

The pixels PXL may be connected to a plurality of scan lines S1 to Sn and data output lines D1 to Dm.

In addition, the pixels PXL may be connected to emission control lines E1 to En.

A connection relationship among the pixels PXL, the scan lines S1 to Sn, the data output lines D1 to Dm, and the emission control lines E1 to En may variously change.

For example, the pixels PXL may be respectively connected to the scan lines and the data output lines.

In another embodiment, the pixels PXL may be respectively connected to the scan lines, the data output lines, and the emission control lines.

In addition, in another embodiment, each of the pixels PXL may be connected to a plurality of scan lines.

The pixels PXL may be connected to a first power source ELVDD and a second power source ELVSS and may receive power source voltages from the first power source ELVDD and the second power source ELVSS.

In addition, each of the pixels PXL may generate light corresponding to a data signal by a current that flows from the first power source ELVDD to the second power source ELVSS via an organic light emitting diode (OLED).

The scan driver 10 generates scan signals by control of the timing controller 70 and may supply the generated scan signals to the scan lines S1 to Sn.

Therefore, the pixels PXL may respectively receive the scan signals through the scan lines S1 to Sn.

The emission control driver 20 generates emission control signals by the control of the timing controller 70 and may supply the generated emission control signals to the emission control lines E1 to En.

Therefore, the pixels PXL may respectively receive the emission control signals through the emission control lines E1 to En.

In FIG. 1, the emission control driver 20 is illustrated as being separate from the scan driver 10. However, according to some embodiments of the present invention, the emission control driver 20 may be integrated with the scan driver 10.

In addition, according to some embodiments of the present invention, the emission control driver 20 and the emission control lines E1 to En may be omitted.

The data driver 30 generates data signals by the control of the timing controller 70 and may supply the generated data signals to data input lines O1 to Oi.

That is, the data driver 30 may supply the data signals to the demultiplexers 50 through the data input lines O1 to Oi.

In FIG. 1, it is illustrated that the number of data input lines O1 to Oi is half of the number of data output lines D1 to Dm. However, a ratio of the data input lines O1 to Oi to the data output lines D1 to Dm may according to the design and structure of the demultiplexers 50.

The demultiplexers 50 receive the data signals from the data driver 30 and may supply the received data signals to the data output lines D1 to Dm.

For example, the demultiplexers 50 receive the data signals through the data input lines O1 to Oi and may time-divisionally output the data signals to the larger number of data output lines D1 to Dm than that of data input lines O1 to Oi.

Therefore, the pixels PXL may respectively receive the data signals through the data output lines D1 to Dm.

In order to store the data signals applied to the data output lines D1 to Dm, capacitors 90 may respectively exist in the data output lines D1 to Dm.

At this time, the capacitors 90 may exist in the data output lines D1 to Dm due to parasitic capacitance that exists in a wiring line. In addition, the capacitors 90 may be physically provided in the data output lines D1 to Dm.

The demultiplxer controller 60 may control operations of the demultiplexers 50 through a data control signal Cd.

For example, the data control signal Cd may control operations of transistors included in the demultiplexers 50.

The demultiplexer controller 60 receives a demultiplexer control signal MCS supplied from the timing controller 70 and may generate the data control signal Cd corresponding to the demultiplexer control signal MCS.

In FIG. 1, the demultiplexer controller 60 is illustrated as being separate from the timing controller 70. However, as occasion demands, the demultiplexer controller 60 may be integrated with the timing controller 70.

The timing controller 70 may control the scan driver 10, the emission control driver 20, the data driver 30, and the demultiplexer controller 60.

For this purpose, the timing controller 70 may respectively supply a scan driver control signal SCS and an emission control driver control signal ECS to the scan driver 10 and the emission control driver 20.

In addition, the timing controller 70 may respectively supply a data driver control signal DCS and a demultiplexer control signal MCS to the data driver 30 and the demultiplexer controller 60.

In FIG. 1, for convenience of illustration, the scan driver 10, the emission control driver 20, the data driver 30, the demultiplexer controller 60, and the timing controller 70 are illustrated as being separate from each other. However, according to some embodiments of the present invention, one or more of the elements may be integrated with each other.

The first power source ELVDD and the second power source ELVSS may provide power source voltages to the pixels PXL positioned in a pixel unit 80. For example, the first power source ELVDD may be a high potential power source and the second power source may be a low potential power source.

For example, the first power source ELVDD may be set as a positive voltage and the second power source ELVSS may be set as a negative voltage or a ground voltage.

An initializing power source INT may supply an initializing voltage Vint to the demultiplexers 50.

For this purpose, an initializing power source line 210 may be connected between the demultiplexers 50 and the initializing power source INT and may provide the initializing voltage Vint to the demultiplexers 50.

The initializing voltage Vint for initializing the data output lines D1 to Dm may be lower than voltages of the data signals supplied to the data output lines D1 to Dm.

In addition, the initializing voltage Vint may be set as the lowest voltage among the voltages of the data signals.

Figure 2:
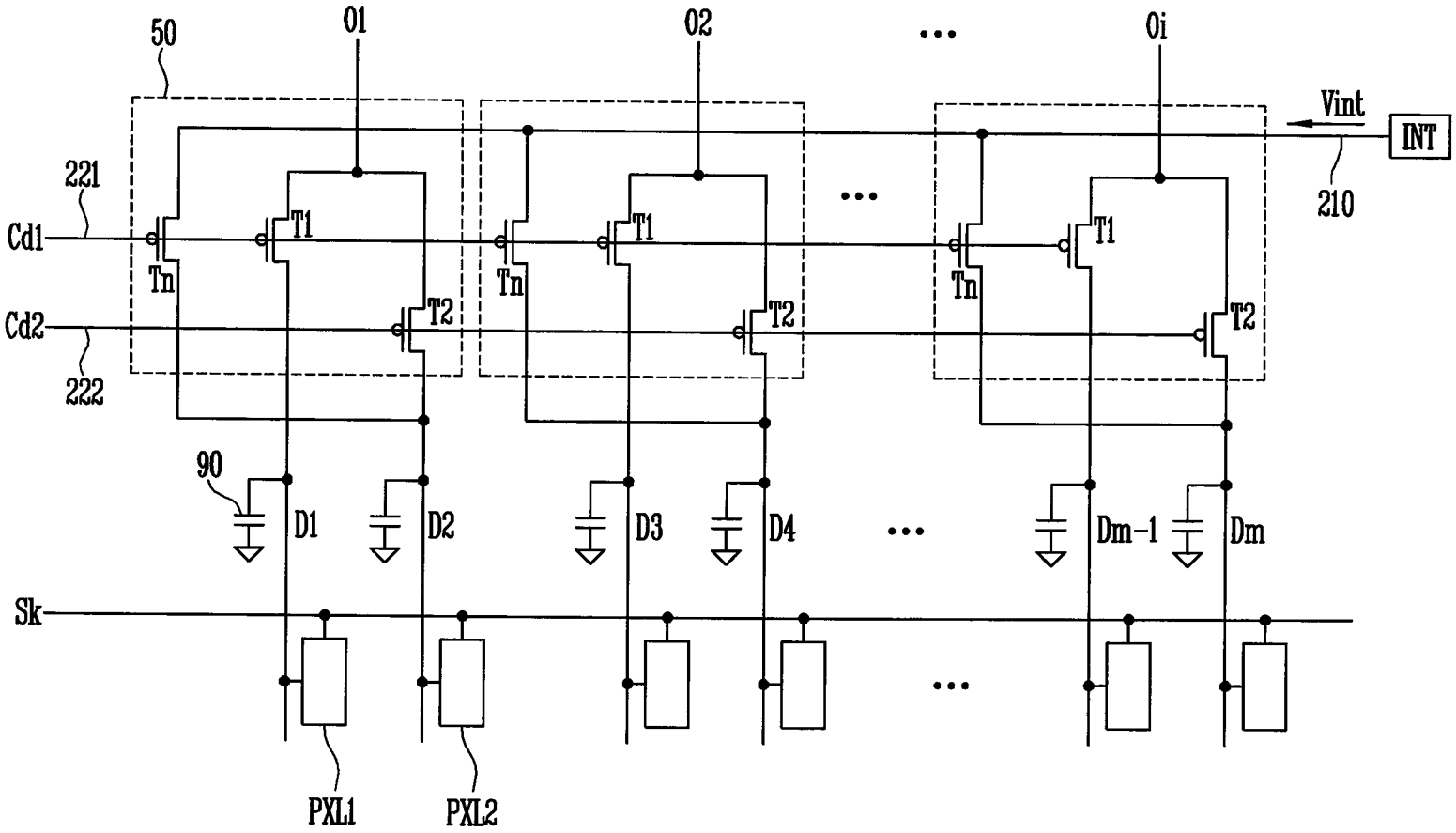
FIG. 2 is a view illustrating a demultiplexer according to an embodiment of the present invention.

FIG. 2 is a view illustrating a demultiplexer according to an embodiment of the present invention. In FIG. 2, for convenience sake, only pixels PXL connected to a kth scan line Sk are illustrated. Here, description will be made based on the demultiplexer 50 connected to the first data input line O1, the first data output line D1, and the second data output line D2.

In addition, the pixels connected to the first data output line D1 are referred to as first pixels PXL1 and the pixels connected to the second data output line D2 are referred to as second pixels PXL2.

The demultiplexer 50 described hereinafter may be applied to a pentile pixel structure.

For example, the first pixels PXL1 connected to the first data output line D1 may display a first color and the second pixels PXL2 connected to the second data output line D2 may display a second color and a third color.

At this time, the first color, the second color, and the third color may be respectively set as red, green, and blue.

In addition, in another embodiment, the first pixels PXL1 connected to the first data output line D1 may display the second color and the third color and the second pixels PXL2 connected to the second data output line D2 may display the first color.

Referring to FIG. 2, the demultiplexer 50 according to the embodiment of the present invention may include a first transistor T1, a second transistor T2, and an initializing transistor Tn.

The first transistor T1 may be connected between the first data input line O1 and the first data output line D1.

In addition, the first transistor T1 may be turned on in response to a first data control signal Cd1.

For example, the first transistor T1 may include a first electrode connected to the first data input line O1, a second electrode connected to the first data output line D1, and a gate electrode connected to a first data control line 221.

The first data control line 221 receives the first data control signal Cd1 from the demultiplexer controller 60 and may transmit the first data control signal Cd1 to the first transistor T1 and the initializing transistor Tn.

The second transistor T2 may be connected between the first data input line O1 and the second data output line D2.

In addition, the second transistor T2 may be turned on in response to a second data control signal Cd2.

For example, the second transistor T2 may include a first electrode connected to the first data input line O1, a second electrode connected to the second data output line D2, and a gate electrode connected to the second data control line 222.

The second data control line 222 receives the second data control signal Cd2 from the demultiplexer controller 60 and may transmit the second data control signal Cd2 to the second transistor T2.

The initializing transistor Tn is concurrently (e.g., simultaneously) turned on with the first transistor T1 and may transmit the initializing voltage Vint to the second data output line D2.

For this purpose, the initializing transistor Tn may be connected between the second data output line D2 and the initializing power source line 210 and may be turned on or off by the first data control signal Cd1 like the first transistor T1.

For example, the initializing transistor Tn may include a first electrode connected to the initializing power source line 210 that provides the initializing voltage Vint, a second electrode connected to the second data output line D2, and a gate electrode connected to the first data control line 221.

As illustrated in FIG. 2, the first transistor T1, the second transistor T2, and the initializing transistor Tn may be implemented by p-type transistors. However, embodiments of the present invention are not limited thereto. For example, the transistors T1, T2, and Tn may be implemented by n-type transistors.

Figure 3:
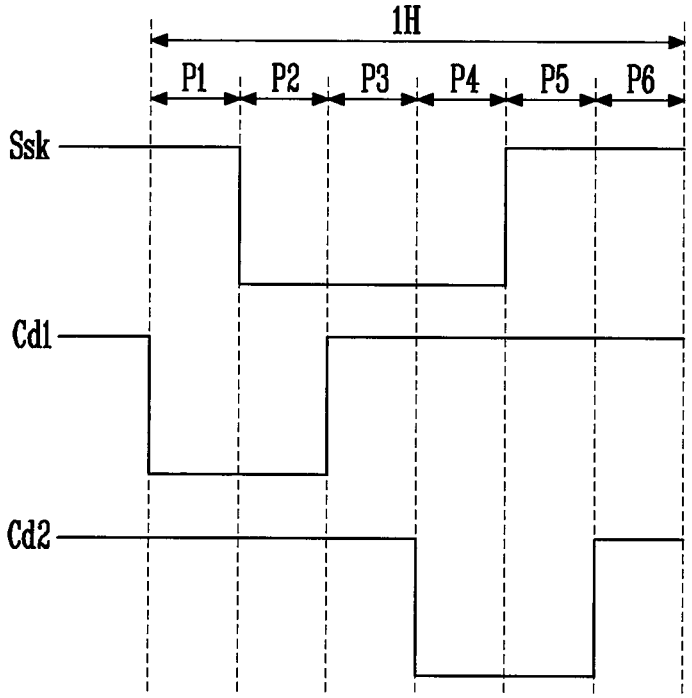
FIG. 3 is a waveform diagram illustrating operation of a demultiplexer according to an embodiment of the present invention.

FIG. 3 is a waveform diagram illustrating operation of a demultiplexer according to an example embodiment of the present invention. In FIG. 3, a scan signal Ssk, the first data control signal Cd1, and the second data control signal Cd2 that are supplied to the kth scan line Sk in a one horizontal period 1H are illustrated.

In addition, in FIG. 3, it is illustrated that the scan signal Ssk, the first data control signal Cd1, and the second data control signal Cd2 are set to have low level voltages. In this case, it is assumed that transistors that receive the signals Ssk, Cd1, and Cd2 are p-type transistors.

Therefore, when the transistors that receive the signals Ssk, Cd1, and Cd2 are n-type transistors, the signals Ssk, Cd1, and Cd2 may be set to have high level voltages.

The scan signal Ssk may overlap the first data control signal Cd1 and the second data control signal Cd2.

In addition, the first data control signal Cd1 and the second data control signal Cd2 may not overlap each other.

That is, the scan signal Ssk and the first data control signal Cd1 may partially overlap in a second period P2 and the scan signal Ssk and the second data control signal Cd2 may partially overlap in a fourth period P4.

Referring to FIGS. 2 and 3, more detail of an example operation of the demultiplexer 50 according to some example embodiments of the present invention will be described.

First, in the first period P1, the first data control signal Cd1 may be supplied. Therefore, the first transistor T1 and the initializing transistor Tn may be turned on.

Because the second data control signal Cd2 is not supplied, in the first period P1, the second transistor T2 may maintain an off state.

As the first transistor T1 is turned on, the first data signal output by the data driver 30 may be transmitted to the first data output line D1 through the first data input line O1 and the first transistor T1.

As the initializing transistor Tn is turned on, the initializing voltage Vint may be supplied to the second data output line D2.

Therefore, in the first period P1, the first data output line D1 may be charged by the first data signal and the second data output line D2 may be initialized by the initializing voltage Vint.

In the second period P2, the first data control signal Cd1 and the scan signal Ssk may be supplied.

Because supply of the first data control signal Cd1 is maintained, electric potentials of the first data output line D1 and the second data output line D2 may be maintained to be the same as those in the first period P1.

As the scan signal Ssk is supplied to the kth scan line Sk, the first data signal of the first data output line D1 may be input to the first pixels PXL1.

In a third period P3, the scan signal Ssk may be supplied. Because the first data control signal Cd1 and the second data control signal Cd2 are not supplied, in the third period P3, the first transistor T1, the second transistor T2, and the initializing transistor Tn may maintain off states.

The third period P3 for preventing the first data control signal Cd1 and the second data control signal Cd2 from overlapping may be set as a short time or may be omitted as occasion demands.

In a fourth period P4, the scan signal Ssk and the second data control signal Cd2 may be supplied.

As the second data control signal Cd2 is supplied, the second transistor T2 may be turned on.

Because the first data control signal Cd1 is not supplied, in the fourth period P4, the first transistor T1 and the initializing transistor Tn may maintain off states.

As the second transistor T2 is turned on, the second data signal output by the data driver 30 may be transmitted to the second data output line D2 through the first data input line O1 and the second transistor T2.

In addition, because the scan signal Ssk is supplied, at the same time, the second data signal of the second data output line D2 may be input to the second pixels PXL2.

Because the second data output line D2 is previously initialized to a low voltage (for example, the initializing voltage Vint) in the first period P1 and the second period P2, a voltage level of the second data output line D2 may be easily changed to a voltage level of the second data signal.

In a fifth period P5, the second data control signal Cd2 may be supplied. The fifth period P5 as a margin period for sufficiently supplying the second data signal to the second data output line D2 may be set as a short time or may be omitted as occasion demands.

In a sixth period P6, all the supplies of the scan signal Ssk, the first data control signal Cd1, and the second data control signal Cd2 may be stopped.

Therefore, the first transistor T1, the second transistor T2, and the initializing transistor Tn may maintain off states.

As resolution increases, a length of the horizontal period 1H is reduced. However, as the length of the horizontal period 1H is reduced, when supply time of the scan signal is not sufficiently secured, picture quality of a display device may deteriorate so that spots may be generated.

Figure 8A:
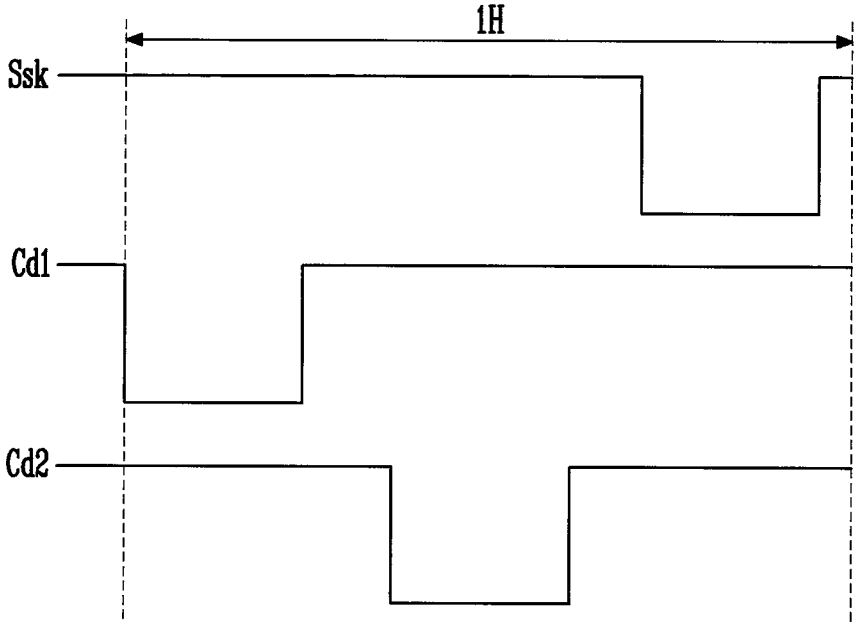
FIGS. 8A and 8B are views illustrating a comparative example of the embodiment of the present invention.

In the first comparative example of FIG. 8A, the first data control signal Cd1 and the second data control signal Cd2 are supplied prior to the scan signal Ssk so that the first data control signal Cd1 and the second data control signal Cd2 do not overlap the scan signal Ssk.

However, in the first comparative example, because the length of the horizontal period 1H is limited, the supply time of the scan signal Ssk may not be sufficiently secured.

On the other hand, according to the embodiment of the present invention, the first data control signal Cd1 and the second data control signal Cd2 partially overlap the scan signal Ssk so that the supply time of the scan signal Ssk may be sufficiently secured in comparison with the first comparative example.

Figure 8B:
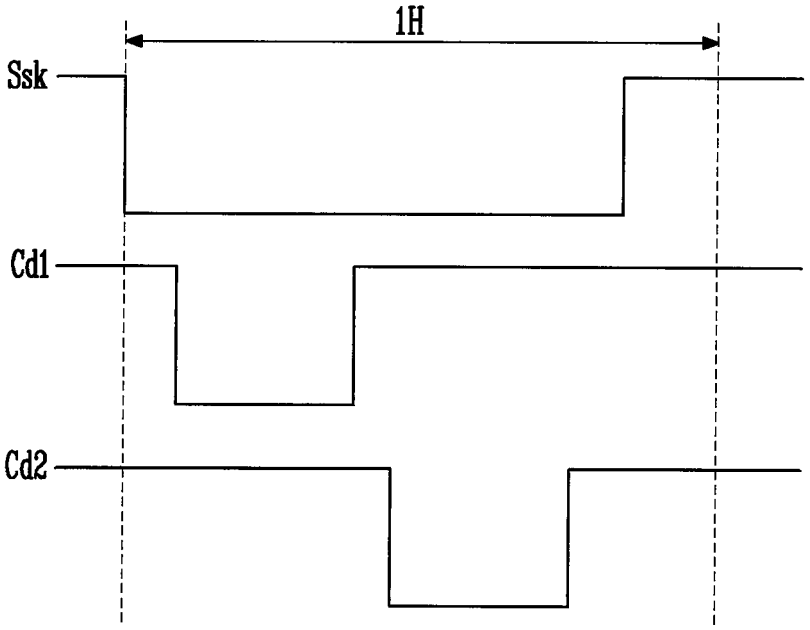

Referring to the second comparative example of FIG. 8B, the first data control signal Cd1 and the second data control signal Cd2 are supplied to completely overlap the scan signal Ssk.

However, in the second comparative example, in the case in which a high voltage is previously charged in the second data output line D2, when the data signal having a low voltage is supplied to the second data output line D2 in the current horizontal period 1H, electric potential of the second data output line D2 does not change.

Therefore, the data signal is not normally applied to the pixel connected to the second data output line D2 so that picture quality may deteriorate.

On the other hand, in the embodiment of the present invention, the second data output line D2 is previously initialized so that the data signal may be normally applied to the second data output line D2.

Figure 4:
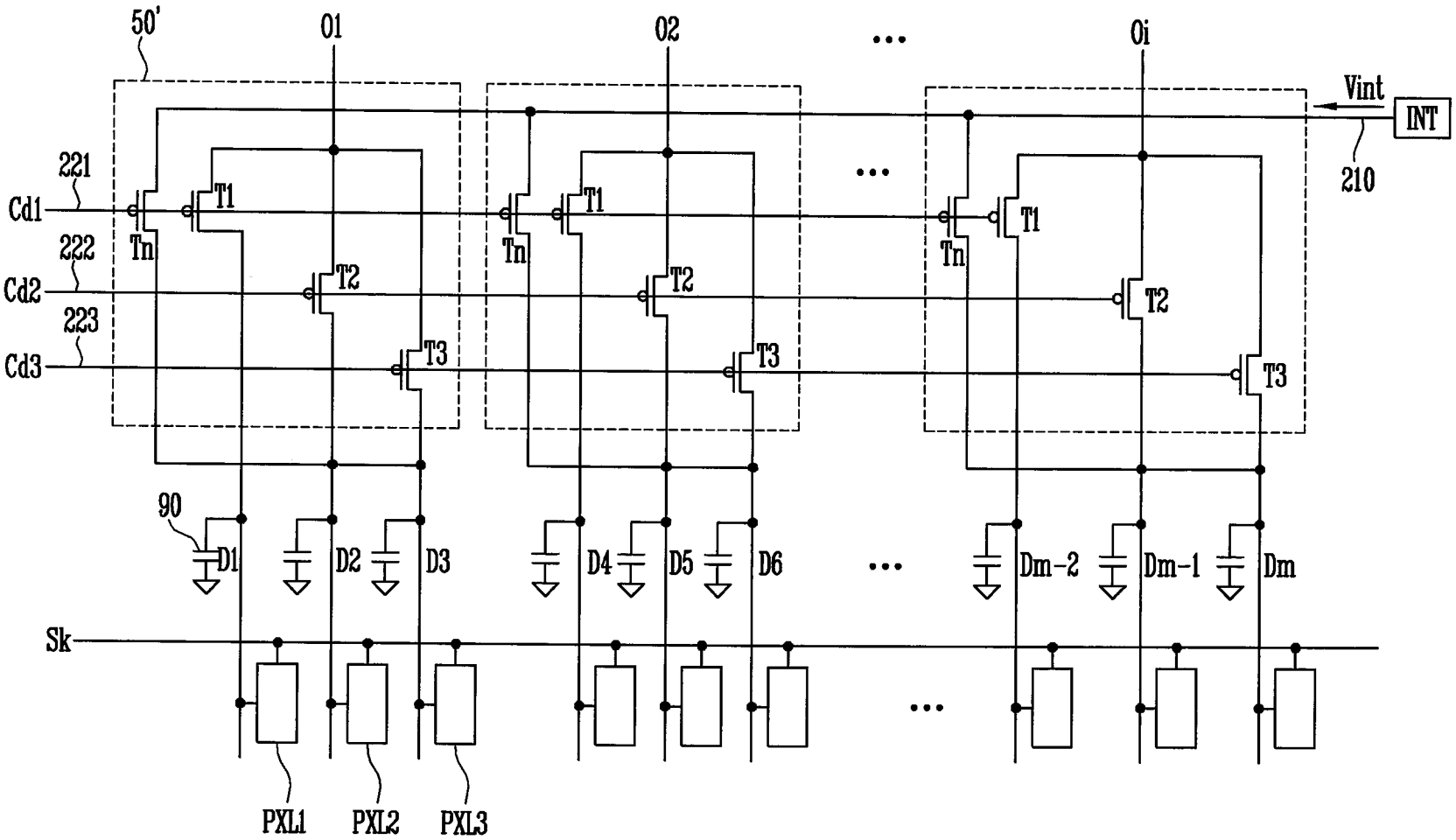
FIG. 4 is a view illustrating a demultiplexer according to another embodiment of the present invention.

FIG. 4 is a view illustrating a demultiplexer according to another embodiment of the present invention. In FIG. 4, for convenience sake, only the pixels PXL connected to the kth scan line Sk are illustrated. Hereinafter, description will be made based on a demultiplexer 50' connected to the first data input line O1, the first data output line D1, the second data output line D2, and the third data output line D3.

In addition, the pixels connected to the first data output line D1 are referred to as first pixels PXL1, the pixels connected to the second data output line D2 are referred to as second pixels PXL2, and the pixels connected to the third data output line D3 are referred to as third pixels PXL3.

The demultiplexer 50' described hereinafter may be applied to an RGB pixel structure.

For example, the first pixels PXL1 connected to the first data output line D1 may display a first color, the second pixels PXL2 connected to the second data output line D2 may display a second color, and the third pixels PXL3 connected to the third data output line D3 may display a third color.

At this time, the first color, the second color, and the third color are different colors and may be selected among green, red, and blue.

Referring to FIG. 4, the demultiplexer 50' according to the embodiment of the present invention may include a first transistor T1, a second transistor T2, a third transistor T3, and an initializing transistor Tn.

The first transistor T1 may be connected between the first data input line O1 and the first data output line D1.

In addition, the first transistor T1 may be turned on in response to the first data control signal Cd1.

For example, the first transistor T1 may include a first electrode connected to the first data input line O1, a second electrode connected to the first data output line D1, and a gate electrode connected to a first data control line 221.

The first data control line 221 receives the first data control signal Cd1 from the demultiplexer controller 60 and may transmit the first data control signal Cd1 to the first transistor T1 and the initializing transistor Tn.

The second transistor T2 may be connected between the first data input line O1 and the second data output line D2.

In addition, the second transistor T2 may be turned on in response to the second data control signal Cd2.

For example, the second transistor T2 may include a first electrode connected to the first data input line O1, a second electrode connected to the second data output line D2, and a gate electrode connected to the second data control line 222.

The second data control line 222 receives the second data control signal Cd2 from the demultiplexer controller 60 and may transmit the second data control signal Cd2 to the second transistor T2.

The third transistor T3 may be connected between the first data input line O1 and the third data output line D3.

In addition, the third transistor T3 may be turned on in response to a third data control signal Cd3.

For example, the third transistor T3 may include a first electrode connected to the first data input line O1, a second electrode connected to the third data output line D3, and a gate electrode connected to a third data control line 223.

The third data control line 223 receives the third data control signal Cd3 from the demultiplexer controller 60 and may transmit the third data control signal Cd3 to the third transistor T3.

The initializing transistor Tn is concurrently (e.g., simultaneously) turned on with the first transistor T1 and may transmit the initializing voltage Vint to the second data output line D2 and the third data output line D3.

For this purpose, the initializing transistor Tn may be connected between the first and second data output lines D1 and D2 and the initializing power source line 210 and may be turned on or off by the first data control signal Cd1 like the first transistor T1.

For example, the initializing transistor Tn may include a first electrode connected to the initializing power source line 210 that provides the initializing voltage Vint, a second electrode connected to the second data output line D2 and the third data output line D3, and a gate electrode connected to the first data control line 221.

As illustrated in FIG. 4, the first transistor T1, the second transistor T2, the third transistor T3, and the initializing transistor Tn may be implemented by p-type transistors. However, embodiments of the present invention are not limited thereto. For example, the transistors T1, T2, T3, and Tn may be implemented by n-type transistors.

Figure 5:
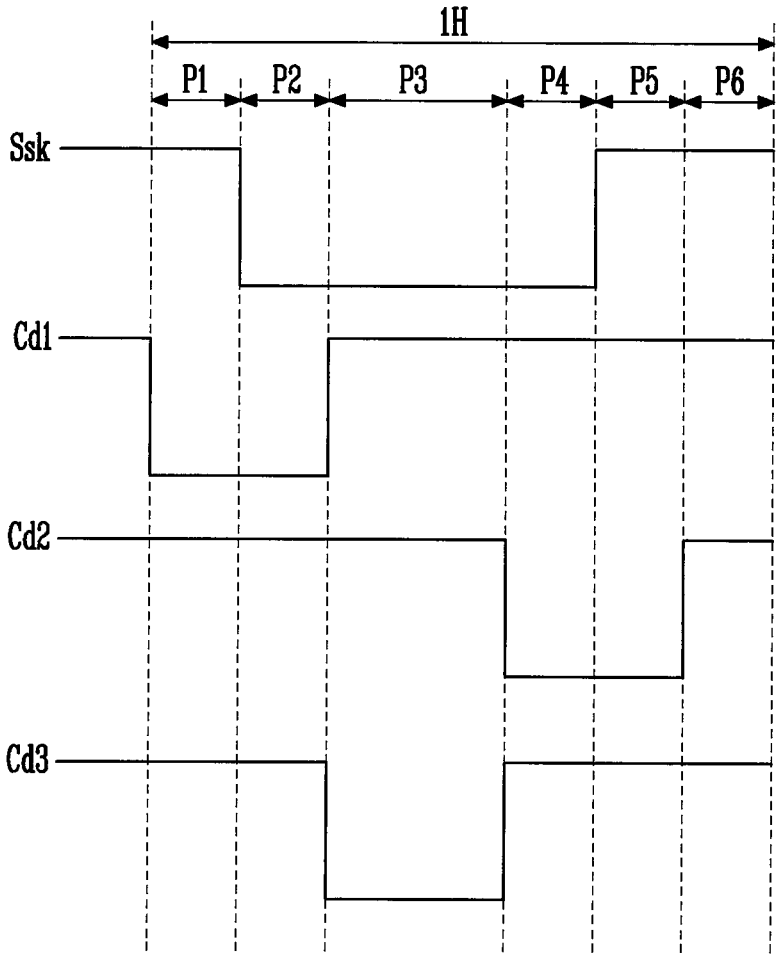
FIG. 5 is a waveform diagram illustrating operation of a demultiplexer according to another embodiment of the present invention.

FIG. 5 is a waveform diagram illustrating operation of a demultiplexer according to another embodiment of the present invention. In FIG. 5, the scan signal Ssk, the first data control signal Cd1, the second data control signal Cd2, and the third data control signal Cd3 that are supplied to the kth scan line Sk in a one horizontal period 1H are illustrated.

In addition, in FIG. 5, it is illustrated that the scan signal Ssk, the first data control signal Cd1, the second data control signal Cd2, and the third data control signal Cd3 are set to have low level voltages. In this case, it is assumed that transistors that receive the signals Ssk, Cd1, Cd2, and Cd3 are p-type transistors.

Therefore, when the transistors that receive the signals Ssk, Cd1, Cd2, and Cd3 are n-type transistors, the signals Ssk, Cd1, Cd2, and Cd 3 may be set to have high level voltages.

The scan signal Ssk may overlap the first data control signal Cd1, the second data control signal Cd2, and the third data control signal Cd3.

In addition, the first data control signal Cd1, the second data control signal Cd2, and the third data control signal Cd3 may not overlap each other.

That is, the scan signal Ssk and the first data control signal Cd1 may partially overlap in a second period P2 and the scan signal Ssk, the second data control signal Cd2 may partially overlap in a fourth period P4, and the scan signal Ssk and the third data control signal Cd3 may partially overlap in a third period P3.

Referring to FIGS. 4 and 5, detailed operation of the demultiplexer 50' according to another embodiment of the present invention will be described.

First, in the first period P1, the first data control signal Cd1 may be supplied. Therefore, the first transistor T1 and the initializing transistor Tn may be turned on.

Because the second data control signal Cd2 and the third data control signal Cd3 are not supplied, in the first period P1, the second transistor T2 and the third transistor T3 may maintain off states.

As the first transistor T1 is turned on, the first data signal output by the data driver 30 may be transmitted to the first data output line D1 through the first data input line O1 and the first transistor T1.

As the initializing transistor Tn is turned on, the initializing voltage Vint may be supplied to the second data output line D2 and the third data output line D3.

Therefore, in the first period P1, the first data output line D1 may be charged by the first data signal and the second data output line D2 and the third data output line d3 may be initialized by the initializing voltage Vint.

In the second period P2, the first data control signal Cd1 and the scan signal Ssk may be supplied.

Because supply of the first data control signal Cd1 is maintained, electric potentials of the first data output line D1, the second data output line D2, and the third data output line D3 may be maintained to be the same as those in the first period P1.

As the scan signal Ssk is supplied to the kth scan line Sk, the first data signal of the first data output line D1 may be input to the first pixels PXL1.

In the third period P3, the scan signal Ssk and the third data control signal Cd3 may be supplied.

Because the first data control signal Cd1 and the second data control signal Cd2 are not supplied, in the third period P3, the first transistor T1, the second transistor T2, and the initializing transistor Tn may maintain off states.

As the third data control signal Cd3 is supplied, the third transistor T3 may be turned on.

As the third transistor T3 is turned on, the third data signal output by the data driver 30 may be transmitted to the third data output line D3 through the first data input line O1 and the third transistor T3.

In addition, because the scan signal Ssk is supplied, at the same time the third data signal of the third data output line D3 may be input to the third pixels PXL3.

Because the third data output line D3 is previously initialized to a low voltage (for example, the initializing voltage Vint) in the first period P1 and the second period P2, a voltage level of the third data output line D3 may be easily changed to a voltage level of the third data signal.

In a fourth period P4, the scan signal Ssk and the second data control signal Cd2 may be supplied.

As the second data control signal Cd2 is supplied, the second transistor T2 may be turned on.

Because the first data control signal Cd1 and the third data control signal Cd3 are not supplied, in the fourth period P4, the first transistor T1, the initializing transistor Tn, and the third transistor T3 may maintain off states.

As the second transistor T2 is turned on, the second data signal output by the data driver 30 may be transmitted to the second data output line D2 through the first data input line O1 and the second transistor T2.

In addition, because the scan signal Ssk is supplied, at the same time, the second data signal of the second data output line D2 may be input to the second pixels PXL2.

Because the second data output line D2 is previously initialized to a low voltage (for example, the initializing voltage Vint) in the first period P1 and the second period P2, a voltage level of the second data output line D2 may be easily changed to a voltage level of the second data signal.

In a fifth period P5, the second data control signal Cd2 may be supplied.

The fifth period P5 as a margin period for sufficiently supplying the second data signal to the second data output line D2 may be set as a short time or may be omitted as occasion demands.

In a sixth period P6, all the supplies of the scan signal Ssk, the first data control signal Cd1, the second data control signal Cd2, and the third data control signal Cd3 may be stopped.

Therefore, the first transistor T1, the second transistor T2, the third transistor T3, and the initializing transistor Tn may maintain off states.

Figure 6:
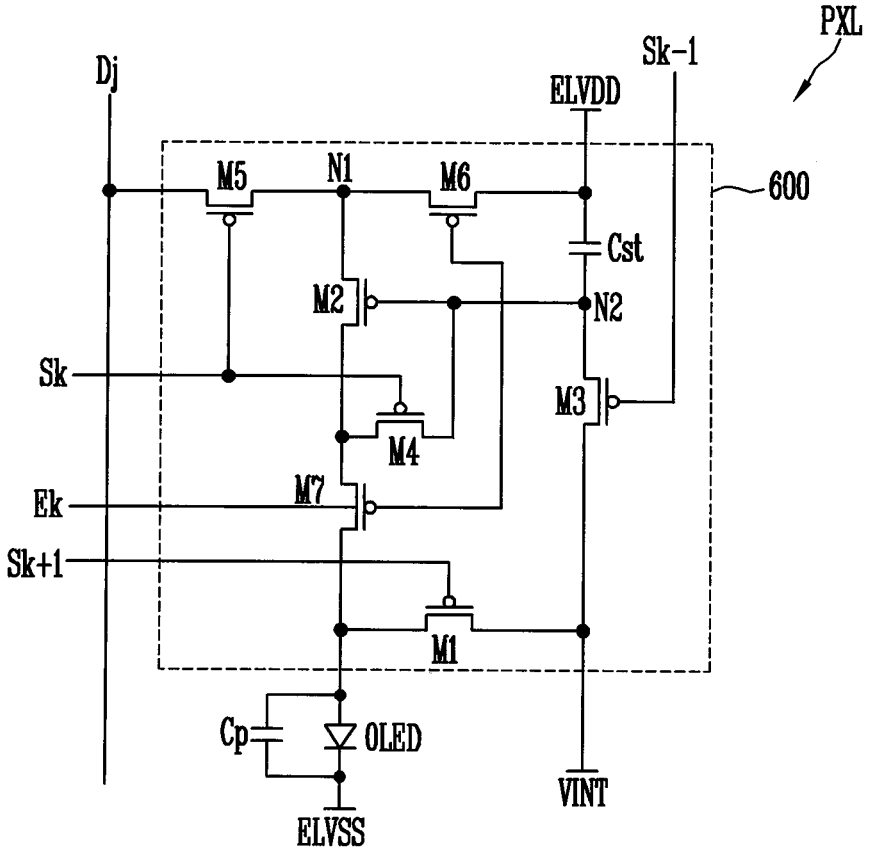
FIG. 6 is a view illustrating an embodiment of the pixel of FIG. 1.

FIG. 6 is a view illustrating an embodiment of the pixel of FIG. 1. In FIG. 6, for convenience sake, a pixel PXL connected to the kth scan line Sk and a jth data line Dj will be described. At this time, k is a natural number of no more than n and j is a natural number of no more than m.

Referring to FIG. 6, the pixel PXL according to the embodiment of the present invention may include an organic light emitting diode (OLED) OLED and a pixel circuit 600.

An anode electrode of the OLED OLED is connected to the pixel circuit 600 and a cathode electrode thereof may be connected to the second power source ELVSS.

The OLED OLED may generate light with predetermined brightness in response to a current supplied from the pixel circuit 600.

The pixel circuit 600 is positioned among the jth data line Dj, the kth scan line Sk, and the anode electrode of the OLED OLED and may control the current supplied to the OLED OLED.

For example, the pixel circuit 600 may control an amount of the current supplied to the OLED OLED in response to the data signal supplied to the jth data line Dj when the scan signal is supplied to the kth scan line Sk.

The pixel circuit 600 may include a plurality of transistors M1 to M7 and a storage capacitor Cst.

The first transistor M1 is connected between the anode electrode of the OLED OLED and a fixed voltage source VINT. Here, the fixed voltage source VINT may supply a voltage lower than that of the data signal.

In addition, the fixed voltage source VINT may be the same power source as the initializing power source INT connected to the above-described demultiplexer 50.

The first transistor M1 is turned on when a scan signal is supplied to a (k+1)th scan line Sk+1 and supplies a voltage of the fixed voltage source VINT to the anode electrode of the OLED OLED.

When the voltage of the fixed voltage source VINT is supplied to the anode electrode of the OLED OLED, a parasitic capacitor Cp that exists in the OLED OLED is initialized.

When the parasitic capacitor Cp is initialized, it is possible to prevent the OLED OLED from emitting light due to a leakage current supplied from the pixel circuit 600 when black brightness is implemented.

That is, the leakage current supplied from the pixel circuit 600 pre-charges the parasitic capacitor Cp and the OLED OLED is set to be in a non-emission state in a period in which the parasitic capacitor Cp is charged.

A first electrode of the second transistor M2 (e.g., a driving transistor) is connected to a first node N1 and a second electrode thereof is connected to a first electrode of the seventh transistor M7.

A gate electrode of the second transistor M2 is connected to a second node N2. The second transistor M2 may control the amount of the current that flows from the first power source ELVDD to the second power source ELVSS via the OLED OLED in response to a voltage charged in the storage capacitor Cst.

A first electrode of the third transistor M3 is connected to the second node N2 and a second electrode thereof is connected to the fixed voltage source VINT.

A gate electrode of the third transistor M3 is connected to a (k−1)th scan line Sk−1.

The third transistor M3 is turned on when a scan signal is supplied to the (k−1)th scan line Sk−1 and may supply the voltage of the fixed voltage source VINT to the second node N2.

A first electrode of the fourth transistor M4 is connected to the second electrode of the second transistor M2 and a second electrode thereof is connected to the second node N2.

A gate electrode of the fourth transistor M4 is connected to the kth scan line Sk.

The fourth transistor M4 is turned on when the scan signal is supplied to the kth scan line Sk and may diode-connect the second transistor M2.

A first electrode of the fifth transistor M5 is connected to the jth data line Dj and a second electrode thereof is connected to the first node N1.

A gate electrode of the fifth transistor M5 is connected to the kth scan line Sk.

The fifth transistor m5 is turned on when the scan signal is supplied to the kth scan line Sk and may transmit the data signal from the jth data line Dj to the first node N1.

A first electrode of the sixth transistor M6 is connected to the first power source ELVDD and a second electrode thereof is connected to the first node N1.

A gate electrode of the sixth transistor M6 is connected to a kth emission control line Ek.

The sixth transistor M6 is turned off when an emission control signal is supplied to the kth emission control line Ek and is turned on when the emission control signal is not supplied.

A first electrode of the seventh transistor M7 is connected to the second electrode of the second transistor M2 and a second electrode thereof is connected to the anode electrode of the OLED OLED.

A gate electrode of the seventh transistor M7 is connected to the kth emission control line Ek. The seventh transistor M7 is turned off when the emission control signal is supplied to the kth emission control line Ek and is turned on when the emission control signal is not supplied.

The storage capacitor Cst is connected between the first power source ELVDD and the second node N2.

Since the above-described pixel structure of FIG. 6 is only an embodiment of the present invention, the pixel PXL according to the present invention is not limited to the above pixel structure. Actually, the pixel circuit 600 has a circuit structure in which a current may be supplied to the OLED OLED and one of currently well-known various circuit structures may be selected as the circuit structure of the pixel circuit 600.

Figure 7:
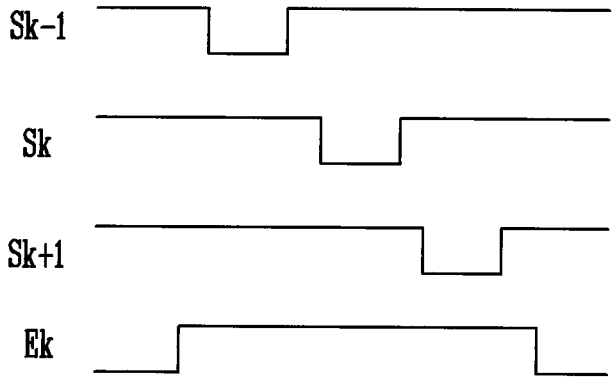
FIG. 7 is a waveform diagram illustrating operation of the pixel of FIG. 6.

FIG. 7 is a waveform diagram illustrating operation of the pixel of FIG. 6.

Referring to FIG. 7, first, the emission control signal is supplied to the kth emission control line Ek so that the sixth transistor M6 and the seventh transistor M7 are turned off.

When the sixth transistor M6 is turned off, electric connection between the first power source ELVDD and the first node N1 is blocked.

When the seventh transistor M7 is turned off, electric connection between the second transistor M2 and the OLED OLED is blocked.

Therefore, in a period in which the emission control signal is supplied to the kth emission control line Ek, the OLED OLED is set to be in a non-emission state.

Then, the scan signal is supplied to the (k−1)th scan line Sk−1 so that the third transistor M3 is turned on.

When the third transistor M3 is turned on, the Voltage of the fixed voltage source VINT is supplied to the second node N2 so that a voltage of the second node N2 is initialized to the voltage of the fixed voltage source VINT.

After the voltage of the second node N2 is initialized to the voltage of the fixed voltage source VINT, the scan signal is supplied to the kth scan line Sk.

When the scan signal is supplied to the kth scan line Sk, the fourth transistor M4 and the fifth transistor M5 are turned on.

When the fourth transistor M4 is turned on, the second transistor M2 is diode-connected.

When the fifth transistor M5 is turned on, the data signal from the jth data line Dj is supplied to the first node N1.

At this time, since the second node N2 is initialized to the voltage of the fixed voltage source VINT, the second transistor M2 is turned on. When the second transistor M2 is turned on, a voltage obtained by subtracting a threshold voltage of the second transistor M2 from a voltage of the data signal applied to the first node N1 is supplied to the second node N2. At this time, the storage capacitor Cst stores the voltage applied to the second node N2.

After the voltage of the data signal is stored in the storage capacitor Cst, the scan signal is supplied to the (k+1)th scan line Sk+1. When the scan signal is supplied to the (k+1)th scan line Sk+1, the first transistor M1 is turned on.

When the first transistor M1 is turned on, the voltage of the fixed voltage source VINT is supplied to the anode electrode of the OLED OLED.

Then, the parasitic capacitor Cp that exists in the OLED OLED is initialized.

Then, supply of the emission control signal to the kth emission control line Ek is stopped so that the sixth transistor M6 and the seventh transistor M7 are turned on.

When the sixth transistor M6 and the seventh transistor M7 are turned on, a current path is formed from the first power source ELVDD to the second power source ELVSS via the OLED OLED.

At this time, the second transistor M2 may supply a driving current corresponding to the voltage charged in the storage capacitor Cst to the OLED OLED.

Therefore, the OLED OLED may emit light with brightness corresponding to the driving current.

Example embodiments of the present invention have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. A demultiplexer comprising:

a first transistor connected between a data input line and a first data output line, the first data output line conveying a first data signal in response to a first data control signal;

a second transistor connected between the data input line and a second data output line, the second data output line conveying a second data signal in response to a second data control signal; and an initializing transistor configured to be simultaneously turned on with the first transistor to transmit an initializing voltage to the second data output line in response to the first data control signal, wherein the first data signal and the second data signal drive pixels in accordance to a scan signal, the scan signal is switched to a turned on level while the first data signal is conveyed, such that the first data control signal for conveying the first data signal overlaps a transition between a high level and a low level of the scan signal, and the scan signal is switched to a turned off level while the second data signal is conveyed, such that the second data control signal for conveying the second data signal overlaps a transition between the low level and the high level of the scan signal.

2. The demultiplexer of claim 1, wherein the first transistor and the initializing transistor are configured to be turned on or off by a same control signal, and wherein the second transistor is configured to be turned on or off by a different control signal as a control signal of the first transistor.

3. The demultiplexer of claim 1, wherein the first transistor comprises a first electrode connected to the data input line, a second electrode connected to the first data output line, and a gate electrode connected to a first data control line.

4. The demultiplexer of claim 3, wherein the second transistor comprises a first electrode connected to the data input line, a second electrode connected to the second data output line, and a gate electrode connected to a second data control line.

5. The demultiplexer of claim 4, wherein the initializing transistor comprises a first electrode connected to an initializing power source line configured to provide the initializing voltage, a second electrode connected to the second data output line, and a gate electrode connected to the first data control line.

6. The demultiplexer of claim 1, further comprising a third transistor connected between the data input line and a third data output line.

7. The demultiplexer of claim 6, wherein the initializing transistor is configured to simultaneously transmit an initializing voltage to the second data output line and the third data output line.

8. The demultiplexer of claim 1, wherein the first transistor and the initializing transistor are configured to maintain on states in a first period, and wherein the second transistor is configured to maintain an on state in a second period that proceeds after the first period.

9. The demultiplexer of claim 1, wherein the turn on level corresponds to a start of the scan signal, and the turn off level corresponds to a termination of the scan signal.

10. A display device comprising:

a first pixel connected to a scan line and a first data output line;

a second pixel connected to the scan line and a second data output line;

a scan driver configured to supply a scan signal to the scan line during a scan period;

a data driver configured to supply a data signal to a data input line; and a demultiplexer configured to transmit the data signal supplied to the data input line to the first data output line and the second data output line, wherein the demultiplexer comprises:

a first transistor connected between the data input line and the first data output line and configured to be turned on in response to a first data control signal;

a second transistor connected between the data input line and the second data output line and configured to be turned on in response to a second data control signal; and an initializing transistor connected between the second data output line and an initializing power source line configured to provide an initializing voltage, the initializing transistor being configured to be turned on in response to the first data control signal, wherein the scan period begins while the first transistor is turned on, such that the first transistor is turned on for a period that overlaps both a period before the scan period begins and a period after the scan period begins, and the scan period ends while the second transistor is turned on, such that the second transistor is turned on for a period that overlaps both a portion of the scan period and a period after the scan period ends.

11. The display device of claim 10, wherein the scan signal overlaps the first data control signal and the second data control signal.

12. The display device of claim 11, wherein the first data control signal is supplied in a first period and a second period, wherein the scan signal is supplied in the second period, a third period, and a fourth period, and wherein the second data control signal is supplied in the fourth period and a fifth period.

13. The display device of claim 10, wherein the first transistor comprises a first electrode connected to the data input line, a second electrode connected to the first data output line, and a gate electrode connected to a first data control line configured to provide the first data control signal.

14. The display device of claim 13, wherein the second transistor comprises a first electrode connected to the data input line, a second electrode connected to the second data output line, and a gate electrode connected to a second data control line configured to provide the second data control signal.

15. The display device of claim 14, wherein the initializing transistor comprises a first electrode connected to the initializing power source line, a second electrode connected to the second data output line, and a gate electrode connected to the first data control line.

16. The display device of claim 10, wherein the display device further comprises a third pixel connected to the scan line and a third data output line, and wherein the demultiplexer further comprises a third transistor connected between the data input line and the third data output line and is configured to be turned on in response to a third data control signal.

17. The display device of claim 16, wherein the third transistor comprises a first electrode connected to the data input line, a second electrode connected to the third data output line, and a gate electrode connected to a third data control line configured to provide the third data control signal.

18. The display device of claim 16, wherein the initializing transistor comprises a first electrode connected to the initializing power source line, a second electrode connected to the second data output line and the third data output line, and a gate electrode connected to a first data control line.

19. The display device of claim 16, wherein the first data control signal is supplied in a first period and a second period, wherein the scan signal is supplied in the second period, a third period, and a fourth period, wherein the second data control signal is supplied in the fourth period and a fifth period, and wherein the third data control signal is supplied in the third period.

20. A method of driving a display device, the method comprising:

turning on a first transistor in a first period and a second period and supplying a first data signal to a first data output line connected to a first pixel;

turning on an initializing transistor in the first period and the second period and supplying an initializing voltage to a second data output line connected to a second pixel;

supplying a scan signal to a scan line connected to the first pixel and the second pixel in the second period, a third period, and a fourth period, such that the scan signal is not supplied in the first period and a fifth period; and turning on a second transistor in the fourth period and the fifth period and supplying a second data signal to the second data output line, wherein the scan signal is supplied to the scan line during a scan period that begins while the first transistor is turned on and the scan period ends while the second transistor is turned on.

21. The method of claim 20, wherein the initializing transistor supplies the initializing voltage to a third data output line connected to a third pixel in the first period and the second period, wherein the method further comprises turning on a third transistor in the third period and supplying a third data signal to the third data output line.

* * * * *